United States Patent [19]

Boilard

[11] Patent Number: 4,509,294

[45] Date of Patent: Apr. 9, 1985

[54] DOOR FRAME ASSEMBLY

[75] Inventor: Raynald Boilard, Comté Beauce Nord, Canada

[73] Assignee: Fernand Flamand Ltee, St.-Henri, Canada

[21] Appl. No.: 524,231

[22] Filed: Aug. 18, 1983

Related U.S. Application Data

[63] Continuation of Ser. No. 183,450, Sep. 2, 1980, abandoned.

[30] Foreign Application Priority Data

Jul. 4, 1980 [CA] Canada ..... 355503

[51] Int. Cl.[3] ..... E06B 1/04

[52] U.S. Cl. ..... 49/504; 49/506; 52/211

[58] Field of Search ..... 49/504, 505, 380, 506; 52/211, 212, 213, 216, 217

[56] References Cited

U.S. PATENT DOCUMENTS

| | | | |
|---|---|---|---|
| 2,781,559 | 2/1957 | Savoie | 49/504 X |
| 3,060,522 | 10/1962 | Parker | 49/505 |
| 3,239,978 | 3/1966 | Parker | 52/217 X |
| 3,250,049 | 5/1966 | Sklar | 52/213 X |
| 3,338,008 | 8/1967 | Sklar | 49/504 X |
| 3,345,780 | 10/1967 | McGhee | 52/211 X |
| 3,769,773 | 11/1973 | Mochizuki | 52/213 X |
| 3,878,648 | 4/1975 | Maune | 49/504 X |
| 4,015,382 | 4/1977 | Noyes | 49/504 X |
| 4,238,909 | 12/1980 | Mutton | 49/504 |

*Primary Examiner*—Philip C. Kannan
*Attorney, Agent, or Firm*—Larson and Taylor

[57] ABSTRACT

An improved method of building a wooden door frame in a door opening of a building without shimming, and a precut and pre-assembled combination of wooden lintel and side post miter end assemblies, each comprising a jamb member with permanently installed outwardly extending mouldings, and if necessary a longitudinally extending doorstop on the main outer surface of the jamb member. The miter ends of the assemblies are precut at 45 degrees at the point of manufacture when all their wooden components have been permanently assembled together, each assembly has a longitudinally extending wide shallow groove for miter L-shaped clips whose horizontally disposed arms are secured to the lintel assembly prior to erection. The free arms of the L-shaped clips extend downwardly away from the lintel mouldings but as close as possible from the ends of the lintel assembly whereby, once the lintel assembly has been horizontally secured in place to the horizontal stud of a partition to be framed, the vertical arms of the L-shaped clips are received in the groove of the jamb member of each side post assembly to guide same so as to provide a perfect miter with minimum effort and time on the part of the carpenter. A cross-piece adjacent the miter end of each jamb member prevents warping thereof and defines, with the shallow groove that it bridges, a slot for receiving the free arm of the corresponding L-shaped clip.

10 Claims, 6 Drawing Figures

DOOR FRAME ASSEMBLY

This is a continuation of application Ser. No. 183,450 filed Sept. 2, 1980, now abandoned.

This invention relates to pre-cut and pre-assembled knocked down door frames made of wood which can be used in the construction industry for door framing openings in partitions, using miter end wood components, normally soft wood components.

In an attempt to reduce construction costs in domestic housing building projects, various attempts have been made in order to facilitate the door framing operations when customary soft wood components are used.

One approach consists of using a completely assembled door frame with a pre-hung door panel in position, which assembly comprised doorjambs and doorstops with mouldings already secured along one of the two edges of the doorjamb member; and once the pre-hung assembly is secured in place to the vertical and horizontal studs in the partition, the carpenter secures a moulding to the other edge of the jamb members to complete the installation. This first approach presents a major storage and transportation inconvenient in that such pre-hung assemblies are quite bulky and fragile.

An other approach consists of making knocked down door frames for standard size doors, and an example of this system is found in U.S. Pat. No. 3,440,783 issued on Apr. 29, 1969 to M. L. Hughes. In such cases, the knocked down door frames consist of three assemblies namely two side post assemblies having a squared lower end and an upper miter end, and a lintel assembly mitered at both ends. In some cases the hinge plates are already secured to the corresponding side post and the strike plate may be mounted to the opposite side post, which greatly facilitates the door hanging operations. However, the main inconvenient of this system is that the miters are nearly always imperfect on account of the fact that some of the components of these assemblies abut each other at the miters. For example, in the above noted Hughes patent, the jamb members are cut at 90 degrees so as to cause abutting engagement with the lintel member of the horizontal assembly. The doorstops also normally meet at 90 degrees in an abutment relationship. In view of the fact that these assemblies are made of soft wood and that consequently it is not possible to maintain accurate dimensions, even when great care is exercised at the point of manufacture, such prior knocked down door frames do not normally produce tight fits at all four miters of the frame unless considerable adjustment is undertaken and carefully effected on the construction site by a skilled carpenter. An other good example of this type of knocked down door frames is found in U.S. Pat. No. 3,040,390 issued on June 26, 1962 to W. H. Carlton, where a rabbet joint is resorted to; but it has been found that with this approach it is equally difficult to obtain acceptable miters at the meeting ends of the mouldings and at those of the doorstop.

Attempts to solve such difficulties are disclosed in the following U.S. patents:

No. 2,781,559, Feb. 19, 1957, Savoie
No. 3,060,522, Oct. 30, 1962, Parker
No. 3,239,978, Mar. 15, 1966, Parker
No. 3,338,008, Aug. 29, 1967, Sklar However, hitherto the construction industry did not have a completely satisfactory system of knocked down door frame made of wood and affording perfect miter joints with the strict minimum labour skill and time as low cost. For example, in the case of the Parker system (3,239,978) a relatively complex system of corner clips and adjustment threaded devices is used which requires time consuming and careful positioning and adjustment. In the case of Sklar, the mouldings are slidably mounted in order to allow for final adjustments at the time of installation on the construction site, which of course partly defeats the purpose of using knocked down door frames which is to save time and costs and permit the construction of acceptable door frames by unskilled labor.

The principal object of this invention is to provide a knocked down door frame which comes as three preassembled assemblies having miter ends and a method of erecting same without shims or any similar means of adjustment within the minimum amount of time by unskilled hands so as to obtain properly fitted miters.

I have found that these objects can be met by using a lintel assembly mitered at both ends at the point of manufacture after permanent assembly of the various wooden components of such lintel assembly, and by using side post assemblies whose upper ends are likewise mitered once the various components thereof had been permanently pre-assembled. In accordance with this invention, I provide a downwardly projecting rigid tongue at each miter end of the lintel assembly and a closely conforming slot at the upper end of each side post assembly.

The method of building a door frame according to my invention involves affixing the lintel assembly to the horizontal stud of the door opening, at a predetermined height and strictly horizontal; positioning a first side post assembly on the adjacent vertical stud by first inserting the projecting tongue of the adjacent miter end of the lintel assembly into the corresponding slot followed by moving this side post assembly to its vertical position while completing the tongue insertion process; nailing this first side post assembly to its adjacent stud while said assembly is held strictly vertical; positioning and nailing the other side post assembly in the same manner; and completing nailing as required.

Cross-pieces are secured to the inner surface of the main plank of each assembly near the miter ends so as to prevent warping, and these cross-pieces which are secured to the side post assemblies define, with the shallow grooves that they bridge, the slots for the tongues of the lintel assembly.

In the accompanying drawings which illustrate a preferred embodiment of this invention, FIG. 1 is a front elevational view of a door frame with the lower part thereof broken away, FIG. 2 is a cross-sectional view at enlarged scale taken along line II—II of FIG. 1, FIG. 3 is a cross-sectional view along line III—III of FIG. 1 but at a scale which is the same as that of FIG. 2, FIG. 4 is a longitudinal partial cross-sectional view taken along line IV—IV of FIG. 3, FIG. 5 is a perspective view of an L-shaped clip to be used at each miter joint in accordance with this invention, and FIGS. 6 is a perspective view of a cross-piece designed to prevent jamb warping.

DESCRIPTION OF A PREFERRED EMBODIMENT

Figure 1:
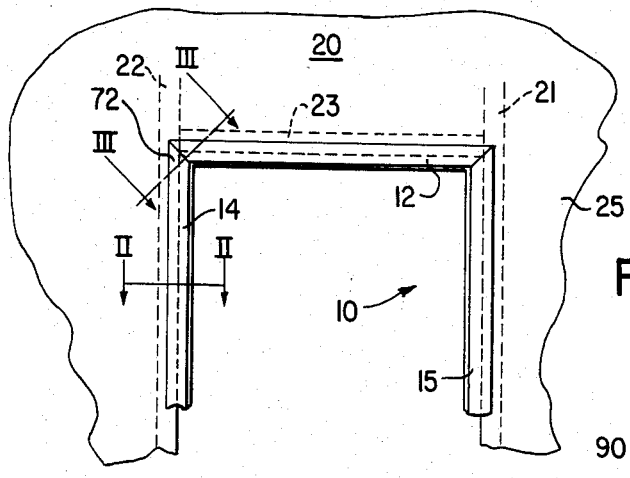

Referring now more specifically to FIG. 1, the door frame is shown generally at reference numeral 10 as comprising lintel assembly 12, and two side post assemblies 14 and 15 which generally conform with sufficient play to the rough opening in partition 20 as defined by vertical studs 21 and 22 and horizontal stud 23, shown in dotted lines in FIG. 1.

In accordance with this invention, and as will be described below in greater detail, each assembly 12, 14 and 15 comprises a central frame member with two opposite mouldings permanently secured to opposite edges of the central member and forming a channel-shaped assembly adapted to extend over the marginal edges of the plaster board 25 already mounted to studs 21, 22 and 23 of the partition. These pre-assembled side post assemblies 14 and 15 and lintel assembly 12 are secured in place by means of a plurality of finishing nails driven into the outer marginal edges of the mouldings into the underlying vertical studs 21, 22 and horizontal stud 23 respectively. This avoids the need to use shims or any other type of adjusting means; the close fitting nature of these miter and subs-assemblies eliminates the fitting procedure and assures tight miters.

Figure 2:
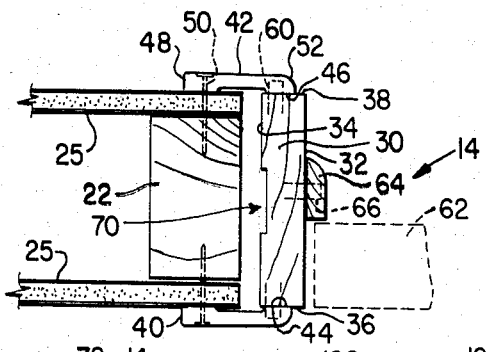

This structure is better illustrated in FIG. 2 which is taken along line II—II of FIG. 1. The illustrated structure of the partition comprises a vertical stud 22 and plaster boards 25 already secured in place to the studding of the partition by suitable means such as nails or screws (not shown) in accordance with conventional building techniques. Side post assembly 14 comprises doorjamb member 30 of essentially constant, rectangular cross-section having a main planar outer surface 32, an inner surface 34, an outer side edge 36 and an inner side edge 38. The casing of this structure consists of an inner jamb moulding 40 and an outer jamb moulding 42 whose respective inner marginal edges 44 and 46 are secured to and cover the inner and outer side edges 36 and 38 of doorjamb member 30. Mouldings 40 and 42 extend parallel to their associated side edges 36 and 38 in the same direction away from outer surface 32 so as to define, with doorjamb member 30, a channel-shaped assembly 14.

The structure of mouldings 40, 42 is conventional. The moulding illustrated in FIG. 2 is relatively thin and wide having a thicker region 48 where the moulding is nailed to the plaster board 25 and vertical stud 22 as at 50. The outer portion of the moulding which is adjacent doorjamb 30 is thinner and rounded as at 52 and it presents an inner flat marginal edge 44 or 46 which is adapted to abut the corresponding side edge 36 or 38 of the doorjamb member 30. The connection of mouldings 40, 42 to the doorjamb member 30 may be effected by means of small nails but the preferred mounting consists of a layer of glue disposed between side edges 36 an 38 on the one hand and inner edges 44 and 46 on the other and staples as at 60 which are used primarily for maintaining the pieces together until the glue has set.

Where a door panel, such as at 62, is intended to be hung to the door frame 10, a doorstop 62 is secured longitudinally of doorjamb member 30 about centrally thereof and it should be sufficient to use staples 66 without any glue for this purpose. Of course where no door panels are to be hung to frame 10, or where folding doors or other forms of closure are to be installed to the frame 10, doorstop 64 may be omitted.

The inner surface 34 of jamb member 30 preferably comprises a relatively wide and shallow groove 70 extending longitudinally of jamb member 30, normally the full length thereof, for assisting in the proper alignment of side post assembly 14 relative to the lintel assembly 12 at the time of installation of the door frame 10, with the assistance of L-shaped clips at each miter as will be described in greater detail below. This groove 70, along the main inner surface 34 of doorjamb member 30, was also found to limit warping of doorjamb member 30 when such is made of relatively green wood as is often the case.

The components used for making the above described side post assembly 14 are soft wood, normally pine or cedar, and doorjamb member 30 may come in different sizes in order to accomodate partitions of different thicknesses. Side post assembly 15 is identical to assembly 14.

A main feature of the present invention resides in the fact that side post assemblies 14 and 15, as described above are entirely constructed at the point of manufacture and their miter ends are cut only once every component has been permanently secured together. Thus, the ends of every component of these assemblies lie in common planes and therefore are even with one another. The lower end (not shown) of side post assembly 14 is cut at 90 degrees (preferably also at the point of manufacture) in order to properly fit adjacent the floor around the base of partition 20, and the upper end 72 of each side post assembly is cut at a 45 degree angle relative to the main outer surface 32 of doorjamb member 30 so that the ends of the various components making up each side post assembly lie in exactly the same plane. The miter end is necessarily cut at the point of manufacture.

Figure 3:
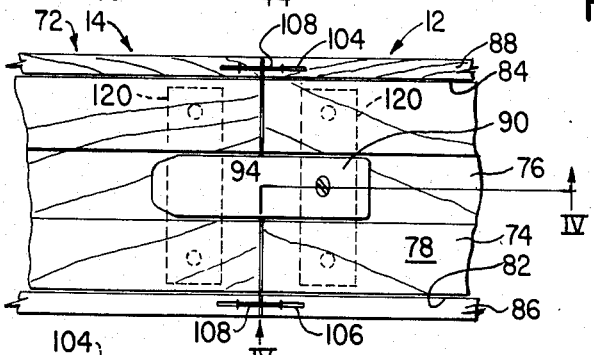

Lintel assembly 12, one end of which is seen in FIG. 3, is constructed in exactly the same fashion as side post assemblies 14 and 15 and it comprises a lintel member 74 which also has a groove 76 on the center of its inner surface 78. Each of its side edges 82 and 84 support mouldings 86 and 88 in the exact same position as applicable in the case of mouldings 40 and 42 in side post assembly 14 illustrated in FIG. 2. Inner lintel moulding 86 does not have to be exactly the same as outer lintel moulding 88 but it should be of the same shape and dimensions as inner doorjamb moulding 40 otherwise their miter joints will not fit closely. Likewise outer lintel moulding 88 must be of the same configuration and dimensions as outer doorjamb moulding 42.

Figure 5:
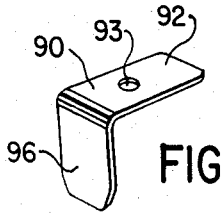
Figure 4:
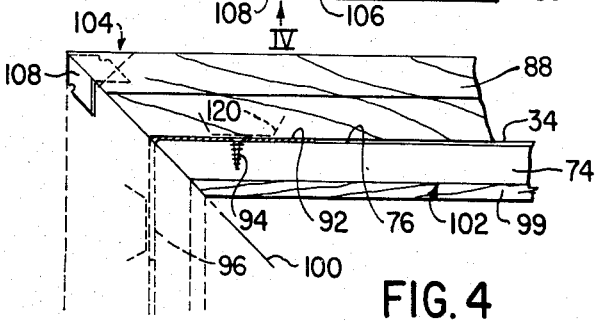

FIG. 3 is a corner cross-sectional view taken along line III—III of FIG. 1 and it illustrates the normally hidden side of a miter joint where lintel assembly 12 meets the upper end 72 of side post assembly 14. FIG. 3 also shows L-shaped clip 90 in position bridging the meeting ends of lintel assembly 12 and of side post assembly 14. This clip 90 is preferably made of a flat strip of spring steel bent to form a right angle or an angle which is slightly less than 90 degrees as shown in FIG. 5. Clip 90 comprises a first arm 92 which has a hole 93 in the middle for receiving a small wood screw 94 for retaining clip 90 to lintel member 74. The right angle arm 96 of clip 90 is designed to be received into groove 70 of door jamb member 30 when side post assembly 14 is properly mounted. The function of clip 90 is to guide side post assembly 14 relative to the position of the adjacent miter end of lintel assembly 12 and consequently the width of arms 92 and 96 of clip 90 should correspond to that of grooves 76 and 70 respectively. In order to obtain a sliding engagement of arm 96 into groove 70, the width of arm 96 should be slightly less than that of groove 70. For ease of manufacture these grooves are of identical dimension and consequently clip 90 is made of a flat strip of even width. The exact positioning of L-shaped clip 90 is perhaps better shown in FIG. 4, which is a partial longitudinal cross-sectional view taken along line IV—IV of FIG. 3. This figure of drawings therefore shows one of the two normally hidden sides of lintel assembly 12, namely the inner surface of lintel moulding 88, the longitudinal cross-section of lintel member 74 with its groove 76, and finally the lintel doorstop 99, which components terminate precisely in the same 45 degree plane 100. Plane 100 and the corresponding 45 degree plane at the opposite end (not shown) of lintel assembly 12 are perpendicular to each other. L-shaped clip 90 has its horizontal arm 92 properly seated and secured into groove 76 by wood screw 94 while its downwardly extending vertical arm 96 extends essentially perpendicularly to the outer main surface 102 of lintel member 74 but as close as possible to the terminal end of groove 76.

A slit 104 or 106 is precut in the pointed ends of the mouldings in order to facilitate insertion of a corner key 108 in order to maintain the outer edges of mouldings 40 and 86 or 42 and 88 in the same common plane.

On the construction site, the framing of a partition opening is easily accomplished using assemblies as described above made in accordance with this invention. The first step consists of temporarily nailing lintel assembly 12 horizontally to stud 23 centrally of the opening, by three or four small finishing nails. A level must be used in order to insure proper positioning of lintel 12. Then, side post assemblies 14 and 15 are inserted and rotated to the vertical position. Starting with the hinge plate side post, for example side post assembly 15, this assembly is guided in position by pushing its upper end upwardly until proper engagement at the miter joint on account of the presence of L-shaped clip 90 already secured in place to the corresponding end of lintel assembly 12. A small wooden wedge acting between the floor and the lower end (not shown) of side post assembly 15 facilitates temporary holding of side post assembly 15 in the exact vertical position (as verified with a level) while the carpenter drives five or six small finishing nails through the inner and outer mouldings into the underlying vertical stud 21. The next operation consists of hanging the door to hinge side post assembly 15, to which the hinge plates has been previously screwed, and then closing the door. Now, the strike plate side post assembly 14 is secured in place with a few nails through its mouldings 40, 42 once it has been positioned as high as necessary to close the miter end, and with its lower end equally spaced from the door panel 62 to leave a gap of even width between its main outer surface 32 and the adjacent edge of door panel 62. Finally, once it has been ascertained that this preliminary positioning of assemblies 12, 14 and 15 allows free movement of door panel 62, the carpenter completes the job by driving more nails through the inner and outer mouldings 40, 42, 86 and 88 and finally by inserting corner keys 108 in slots 104 and 106 at the top of both miter joints on each side of the door frame.

It will be appreciated that this method of door framing does not require any shims between the vertical and horizontal studs and the adjacent assemblies 12, 14, and 15, and it should also be apparent that since the miter ends of these assemblies have been precut at the point of manufacture to the exact dimension of the desired door opening, the job of the carpenter on the construction site is considerably simplified and only takes a few minutes. Moreover, the miter joints are necessarily very accurate because every component of each assembly 12, 14 and 15 was permanently secured prior to cutting at 45 degree which can be accurately controlled when this operation is carried out with the use of standard industrial tooling at the point of manufacture.

Figure 6:
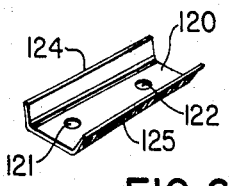

It has been found that jamb members 30 and lintel member 74, when made of green soft wood, tend to warp sufficiently at their free ends (in spite of the presence of groove 70 and 76) that the ends of mouldings 40, 42, 86 and 88 tend to gradually separate from the surface of plaster board 25 as the wood of the door frame dries. Thus, in accordance with this invention, I provide one cross-piece 120 at each miter end of every subassembly 12, 14 and 15. It was soon realized that these cross-pieces 120, one of which is shown in perspective view in FIG. 6, define with the shallow grooves that they bridge, slots and also serve to better retain L-shaped clips 90 in place, and that they facilitate closing of the miters during the framing operation. I use U-shaped steel cross-pieces that are about as long as the width of the jambs members, with two small holes 121, 122 for wood screws (not shown). They are secured in place over the shallow groove 70 or 76 as close as possible to the adjacent mitered free end of the jamb member, preferably at the point of manufacture. Considering the force exerted by the warping wood, which must be counteracted by these cross-pieces 120, I prefer to use U-shaped cross-pieces with slightly diverging flanges 124, 125 made of spring steel but other shapes are obviously contemplated. The thickness of cross-pieces must be limited in view of the restricted gap between hidden surface 34 of the jambs or lintel members and the outer wide surface of the adjacent stud 21, 22 or 23. There is no real need to put cross-pieces 120 elsewhere than at the miters.

Thus, the invention provides pre-cut, pre-assembled channel-shaped framing assemblies which are delivered in discrete form ready to be installed to the partition to be framed. The present kit of parts may of course comprise a door panel with hinge plates and latch hardware in place or ready to be screwed in place if holes and grooves had been made at the point of manufacture. The side part assemblies may also comprise grooves or indentations and holes to facilitate mounting of the hinge plates and strike plates, although these accessories could be installed at the point of manufacture. The door panel is not necessarily supplied with the knocked down frame assembly; in some cases no door panel is to be filled to the framed doorway; in other cases, standard sized door panels of accurately predetermined dimensions and characteristic may be selected which would be compatible with such a combination of two side post assemblies and one lintel assembly.

I claim:

1. A knocked down door frame comprising three factory made assemblies made of wood components and hardware means and designed to be readily mounted without shim means to a wall opening in a building, which opening is defined by a horizontal stud and two vertical spaced apart studs, said assemblies consisting of a lintel assembly adapted to be secured adjacent said horizontal stud and two side post assemblies adapted to be secured to said vertical studs respectively, each side post assembly comprising a door jamb member of constant, generally rectangular cross-section having a main planar outer surface, an inner surface, an outer side edge and an inner side edge, an outer jamb moulding permanently secured along one of its margins to said outer side edge so as to substantially cover same and extend in the plane of said outer side edge away from said main planar outer surface, an inner jamb moulding permanently secured along one of its margins to said inner side edge so as to substantially cover same and extend in the plane of said inner side edge away from said main planar outer surface, said lintel assembly comprising the combination of a lintel member whose cross-section is identical to that of said door jamb member having a main outer surface, an inner surface, an outer side edge and an inner side edge, an outer lintel moulding having the profile and transverse dimensions of said outer jamb mouldings, permanently secured to the outer side edge of said lintel member in the same position as in the case of said outer jamb mouldings, and an inner lintel moulding having the profile and transverse dimensions of said inner jamb mouldings, permanently secured to the inner side of said lintel member in the same position as in the case of said inner jamb mouldings, wherein both ends of said lintel assembly are pre-cut at the point of manufacture at exactly 45 degree angles with respect to the main outer surface of said lintel member so as to produce miter ends, wherein the upper end of each side post assembly is pre-cut at the point of manufacture at an angle of exactly 45 degrees with respect to the main outer surface of the respective door jamb member so as to produce a miter end thereat, whereby at every miter end of each assembly every component thereof terminates in a commo plane which extends across the assembly at an angle of 45 degrees with respect to the corresponding main outer surface, wherein said inner surface of the door jamb member of each side post assembly and the inner surface of the lintel member of said lintel assembly have a longitudinally extending shallow, wide groove of rectangular cross-section extending at least in the region of every miter end and reaching the corresponding common plane, which groove is preferably disposed centrally of the width of the corresponding inner surface, wherein said hardware means comprises a rigid cross-piece for every miter end to be secured transversally of said groove so as to bridge same close to the corresponding miter end and an L-shaped clip to be mounted at each miter end of said lintel assembly, each L-shaped clip having a first and a second flat arms defining an angle of about 90 degrees, the first arm being adapted to be secured prior to erection of said door frame in the groove of said lintel assembly under said cross-piece with the second arm extending generally perpendicularly of the main outer surface of said lintel assembly away from said inner and outer lintel mouldings, said second flat arm being adapted to fit closely into the groove of the miter end of the adjacent side post assembly under the corresponding cross-piece upon erection of said door frame.

2. A knocked down door frame as defined in claim 1 wherein said L-shaped clip is made of a flat strip of steel of constant width and thickness, respectively equal to or just slightly less than the width and depth of said grooves in said assemblies, which grooves are all of the same width and depth, the free end of said second arm tapering slightly in order to facilitate its insertion into the corresponding groove under the corresponding cross-piece.

3. A knocked down door frame as defined in claim 2 wherein each cross-piece is a length of U-shaped steel about as long as the width of said door jamb members secured in place over the corresponding groove by means of wood screws at the point of manufacture, wherein said hardware also comprises hinge plates to be installed on one of said side post assemblies and latch hardware for the other side post assembly, and wherein each assembly also comprises a door stopper permanently secured at the point of manufacture.

4. A knocked down door frame as defined in claim 3 wherein said length of U-shape steel has its flanges narrow and slightly outwardly extending.

5. A knocked down door frame comprising three factory made assemblies namely a lintel assembly and two side post assemblies all made of wood and hardware means and designed to be readily mounted without shim means to a wall opening in a building defined by a horizontal stud and two spaced apart vertical studs, each lintel and side post assembly being channel shaped and comprising a main wooden solid plank and two wing-like mouldings secured to the opposite edges of said plank, each end of said lintel and the upper end of each side post assembly being factory mitered and having a rigid cross-piece on the inner surface of said planks to prevent warping of said planks at the miter ends thereof, said hardward means comprising means at each miter end of said lintel defining a rigid downwardly projecting tongue adapted to cooperate with the adjacent side post assembly in order to precisely guide same laterally, inwardly and outwardly during the erection of said door frame assembly, and each side post assembly defining, at its miter end, a slot for closely receiving the corresponding tongue whereby to achieve perfect joints at said miter ends without shimming or other similar means of adjustment.

6. A knocked down door frame as defined in claim 5 wherein said slot at the miter end of each side post assembly is at least partially defined by the corresponding cross-piece, and wherein said cross-pieces are lengths of U-shape steel about as long as the width of said plank and are secured thereto on the inner surface thereof by means of wood screws.

7. A knocked down door frame as defined in claim 6 wherein said cross-pieces are part of said hardware means which is factory installed, and wherein said means defining a tongue is a strip of steel of essentially constant width bent so as to form first and second arms at about 90 degrees relative to each other, said first arm being secured to said lintel assembly under the adjacent cross-piece while said second arm tapers at its free end and forms said tongue.

8. A knocked down door frame as defined in claim 7 wherein each cross-piece has a flat planar bearing surface engaging the inner surface of the corresponding plank, and wherein each plank is provided, on its inner surface, a centrally located shallow, wide groove whose width and depth correspond to the width and thickness of said strip of steel.

9. A method of building a door frame in a door opening of a building wall defined by a horizontal stud and two spaced apart vertical studs, without shims or any similar adjustment means, using a knocked down door frame as defined in claim 1, with its hardware means in place, comprising the following successive sequential steps:

(a) affixing said lintel assembly in a strictly horizontal position to said horizontal stud, centrally of said door opening and at a predetermined height above the floor, (b) positioning a first side post assembly in a vertical position on one of said vertical studs by first inserting the second arm of the corresponding L-shaped clip into the groove of said first side post assembly followed by moving the first side post assembly to the vertical position while completing insertion of the last mentioned second arm into its adjacent groove, (c) nailing said first side post assembly in a strictly vertical position, (d) positioning and nailing the other side post assembly on the other vertical stud in the same manner as steps (b) and (c) above, and (e) completing nailing of said lintel and side post assemblies to their respective studs as required.

10. A method of building a door frame in a door opening of a building wall defined by a horizontal stud and two spaced apart vertical studs, without shims or any similar adjustment means, using a knocked down door frame as defined in claim 5, with its hardware in place, comprising the following successive sequential steps:

(a) affixing said lintel assembly in a strictly horizontal position to said horizontal stud, centrally of said door opening and at a predetermined height above the floor, (b) positioning a first side post assembly in a vertical position on one of said vertical studs by first inserting the adjacent tongue into the slot of said first side post assembly followed by moving said first side post assembly to the vertical position while completing insertion of the last mentioned tongue into its adjacent deep slot, (c) nailing said first side post assembly in a strictly vertical position, (d) positioning and nailing the other side post assembly on the other vertical stud in the same manner as steps (b) and (c) above, and (e) completing nailing of said lintel and side post assemblies to their respective studs as required.

* * * * *